US010969208B2

(12) United States Patent
Evans

(10) Patent No.: US 10,969,208 B2
(45) Date of Patent: Apr. 6, 2021

(54) HYBRIDIZED FRAGMENTING PROJECTILE

(71) Applicant: Lehigh Defense, LLC, Quakertown, PA (US)

(72) Inventor: Justin T. Evans, Summerset, SD (US)

(73) Assignee: Lehigh Defense, LLC, Quakertown, PA (US)

( * ) Notice: Subject to any disclaimer, the term of this patent is extended or adjusted under 35 U.S.C. 154(b) by 45 days.

(21) Appl. No.: 16/571,990

(22) Filed: Sep. 16, 2019

(65) Prior Publication Data

US 2021/0063128 A1 Mar. 4, 2021

Related U.S. Application Data

(60) Provisional application No. 62/841,950, filed on May 2, 2019.

(51) Int. Cl.
*F42B 12/34* (2006.01)
*F42B 33/00* (2006.01)

(52) U.S. Cl.
CPC ..... *F42B 12/34* (2013.01); *F42B 33/00* (2013.01)

(58) Field of Classification Search
USPC ..... 102/506–509
See application file for complete search history.

(56) References Cited

U.S. PATENT DOCUMENTS

| | | | |
|---|---|---|---|
| 2,290,851 | A | 7/1942 | Addicks |
| 5,515,787 | A | 5/1996 | Middleton |
| 6,776,101 | B1 | 8/2004 | Pickard |
| 7,681,504 | B2 | 3/2010 | Machina et al. |
| 9,212,876 | B1 | 12/2015 | Kostka et al. |
| 9,354,027 | B2 | 5/2016 | Flint et al. |
| 2017/0234664 | A1 | 8/2017 | Golloher et al. |
| 2018/0106581 | A1 | 4/2018 | Rogers |
| 2018/0112961 | A1 | 4/2018 | Muster et al. |
| 2018/0313639 | A1 | 11/2018 | Peterson |

*Primary Examiner* — Reginald S Tillman, Jr.
(74) *Attorney, Agent, or Firm* — Fox Rothschild LLP

(57) ABSTRACT

The disclosure relates to a hybridized fragmenting projectile having slots with divergent surfaces that intersect at a joint having a curved proximal portion. The projectile fragments effectively upon impact with a target after being fired from a firearm at either subsonic or supersonic speed, regardless of environmental conditions or whether the firearm user adjusts the firearm to change between supersonic operation and subsonic operation.

16 Claims, 8 Drawing Sheets

HYBRIDIZED FRAGMENTING PROJECTILE

BACKGROUND

Expanding projectiles are generally designed to spread apart upon impact—e.g., mushrooming projectiles or projectiles having petal fragments that separate and shear away from a base portion. Fragmenting projectiles direct significant power at a target. Supersonic projectiles, which discharge from a weapon at greater than about 1120 fps, are propelled with sufficient force to fragment when hitting virtually any target regardless of the projectile's profile or geometry. The propulsion force of subsonic projectiles, however, is typically insufficient to effectively cause a fragmenting projectile to break apart upon impact with a target. Some fragmenting projectiles have been designed to fragment at subsonic speeds (i.e., below 1120 fps and generally between 750 fps and 1150 fps) or supersonic speeds (i.e., above 1120 fps and generally between 1800 fps and 4500 fps). Thus, there is a need for a hybridized fragmenting projectile that can perform effectively at a wide range of speeds that encompasses both subsonic and supersonic speeds.

SUMMARY

In one aspect, the disclosed technology relates to a hybridized fragmenting projectile including: a base having a central cavity; at least two adjacent petals integrally formed with the base, surrounding the central cavity, and separated from each other by a slot having divergent surfaces, wherein the divergent surfaces intersect at a joint; and a meplat; wherein the projectile is configured to fragment upon impact with a target after being fired from a firearm, regardless of whether the projectile is fired at supersonic or subsonic speed. In one embodiment, at least one petal is configured to separate from the base and form fragments upon impact with the target. In another embodiment, the projectile is configured to fragment upon impact at a speed of less than 1100 fps. In another embodiment, the projectile is further configured to fragment upon impact at a speed of more than 1100 fps. In another embodiment, the hybridized fragmenting projectile includes three petals alternatingly arranged with three slots. In another embodiment, the hybridized fragmenting projectile includes four petals alternatingly arranged with four slots. In another embodiment, the joint includes a curved proximal portion. In another embodiment, the joint further includes a curved distal portion. In another embodiment, the joint further includes a linear middle portion. In another embodiment, the linear middle portion is substantially parallel to a longitudinal axis of the projectile.

In another aspect, the disclosed technology relates to a method of manufacturing a slot of a hybridized fragmenting projectile, including the steps of: (a) making an entry cut into an outer surface of a projectile blank; (b) translating the cut longitudinally along a first curved path in the outer surface of the projectile blank; (c) translating the cut longitudinally along a linear path in the outer surface of the projectile blank, wherein the linear path is substantially parallel to a longitudinal axis of the projectile body; (d) translating the cut longitudinally along a second curved path in the outer surface of the projectile blank; and (e) terminating the cut to form the slot. In one embodiment, step (b) is performed before step (c). In another embodiment, step (b) is performed after step (c). In another embodiment, the cuts are formed using a rotating circular tool. In another embodiment, the rotating circular tool includes a blade having an edge with angled sides.

BRIEF DESCRIPTION OF THE DRAWINGS

The following drawings are illustrative of particular embodiments of the present disclosure and do not limit the scope of the present disclosure. The drawings are not to scale and are intended for use in conjunction with the explanations in the following detailed description. Various non-limiting embodiments will be described in detail with reference to the drawings, wherein like reference numerals represent like parts and assemblies throughout the several views.

DETAILED DESCRIPTION

The disclosed technology general relates to a hybridized fragmenting projectile that fragments effectively at both subsonic and supersonic speeds. Further, when used in combination with a propellant designed to operate at or near the transition speed between subsonic and supersonic speeds, the disclosed projectile will operate effectively regardless of environmental conditions that might affect the actual projectile speed. Hence, the disclosed hybridized fragmenting projectile can be used with a wide range of firearm projectile exit speeds, even if a user adjusts the firearm to change between supersonic and subsonic operation (i.e., to change the exit speed of the projectile to be either above or below the transition speed)—e.g., by adding or removing a suppressor, or adjusting the amount of return gases in a gas-operating firearm. In some embodiments, the disclosed projectile fragments effectively when discharged from a firearm at speeds of about 600 fps to about 5000 fps, such as about 700 fps to about 4000 fps, about 800 fps to about 3000 fps, about 900 fps to about 2000 fps, about 1000 fps to about 1500 fps, or about 1100 fps to about 1200 fps. In some embodiments, the projectile has generally V-shaped slots with divergent wall surfaces, and joints having either linear or curved proximal portions. In other embodiments, the projectile has joints with curved proximal portions, and slots with wall surfaces that are either divergent or non-divergent (e.g., parallel).

Figure 1B:
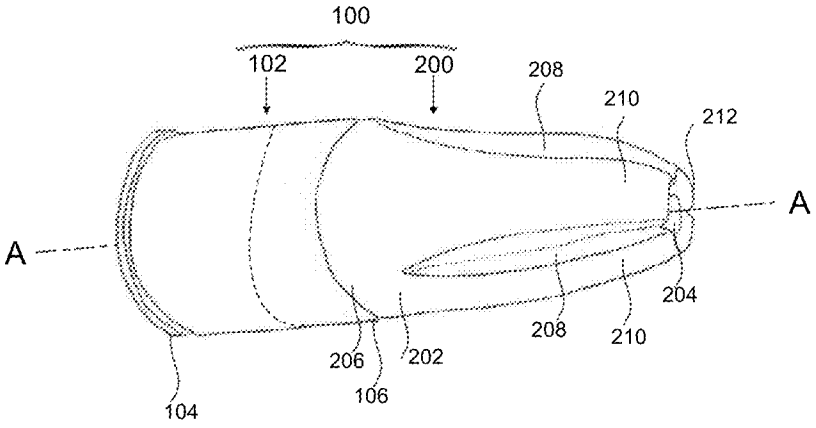
FIG. 1B is a perspective view of the cartridge of FIG. 1A.
Figure 1A:
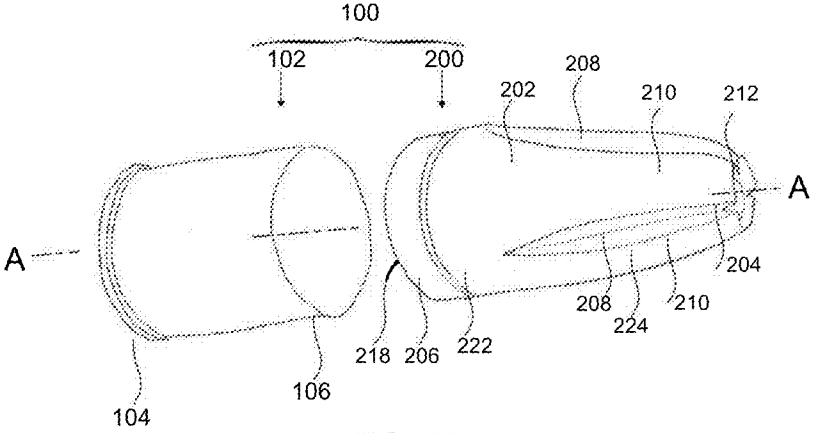
FIG. 1A is an exploded perspective view of an embodiment of a cartridge utilizing a hybridized fragmenting projectile having three petals alternatingly arranged with three slots.
Figure 1D:
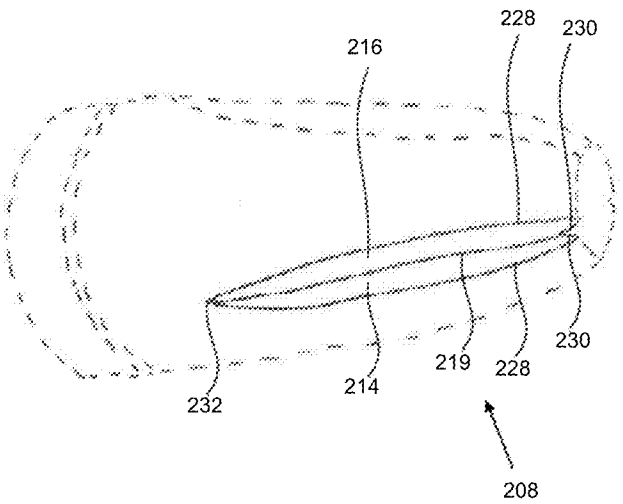
FIG. 1D is a perspective view of a slot of the projectile of FIG. 1A.
Figure 1C:
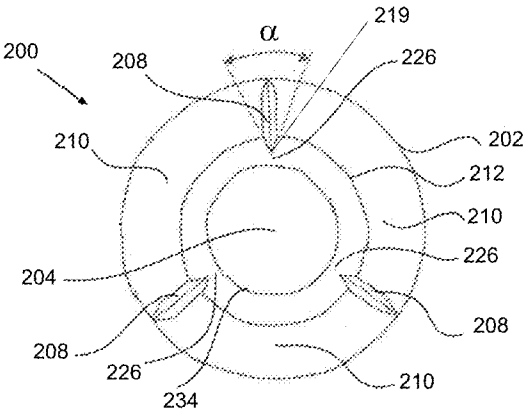
FIG. 1C is a meplat end view of the projectile of FIG. 1A.

FIGS. 1A and 1B are exploded perspective and perspective views, respectively, of an embodiment of a cartridge 100 including an example hybridized fragmenting projectile 200 (e.g., a bullet) having a longitudinal axis A. FIG. 1C depicts a meplat end view of projectile 200. In general, meplat 212 is the furthest frontal plane of the projectile, and is the first surface of the projectile that contacts the air or a target after being fired from a firearm.

Cartridge 100 may include an annular casing 102 having a primer (not shown) disposed at a first end 104 thereof casing 102 includes an open second end 106 into which projectile 200 is inserted during manufacture and assembly. A propellant (e.g., gunpowder) may be introduced into the interior of casing 102. Upon ignition of the primer and propellant, the projectile 200 is discharged from the firearm (e.g., a rifle). In typical automatic weapons, the force caused by the ignition is sufficient to both discharge projectile 200 and cycle a new cartridge 100 into the weapon's firing chamber. Projectile 200 includes a body 202, which may be formed from a unitary material or a mixture of materials. For example, projectile body 202 described herein may be monolithic and formed from solid copper or brass. Non-limiting examples of acceptable materials include copper, solid copper, copper alloy, copper-jacketed lead, copper-jacketed zinc, copper-jacketed tin, powdered copper, brass, powdered brass, powdered tungsten matrix, steel, stainless steel, aluminum, tungsten carbide, and combinations thereof.

As shown in FIGS. 1A-1C, projectile 200 may have a monolithic solid copper body 202 with a base 206 and at least two petals 210 (e.g., two, three, four, five, or more petals) integrally formed with the base and surrounding a central cavity 204 (e.g., a deep drilled hole). In one embodiment, the central cavity 204 is formed by removing a section of material (e.g., by a drill) from a raw material or intermediate component. In some instances of use, the cavity will fill with fluid upon impact, thereby creating greater pressure and outward forces, which in turn fracture and shear the petals 210 of projectile 200.

A plurality of longitudinal slots 208 along the outer surface of the projectile body 202 form an equal number of petals 210. Slots 208 may be formed by removing sections of material from projectile body 202. In general, the slots are positioned to aid in the fracturing of projectile 200 so as to achieve the desired fragmentation upon impact with a target. In the example depicted in FIGS. 1A-1C, projectile 200 has three slots 208 that are evenly spaced from each other by, and define, three petals 210. Fewer or more slots 208 and petals 210 may also be used.

In some embodiments, slots 208 are generally symmetrical and/or V-shaped. As shown in FIG. 1A, slots 208 may be formed in the outer surfaces of both a cylindrical body portion 222 and a curved ogive portion 224 located along a front portion of projectile 200. As depicted in FIG. 1D, each slot 208 is defined by two congruent surfaces 214, 216 that may form divergent surfaces of the petals 210—i.e., one surface 214 from one petal 210 is divergent from an adjacent surface 216 from an adjacent petal 210. Each congruent surface 214, 216 may have an angular radius that either varies or is substantially constant along its length from meplat 212 towards rear edge 218 of projectile 200.

When a fragmenting projectile impacts a target, the amount of energy required to separate adjoining petals from each other depends largely on the localized stress concentrations of the connective material at or near the meplat. A projectile formed with slots 208 having divergent (e.g., V-shaped) surfaces provides superior fragmentation as the petals 210 can easily shear from the projectile 200 upon impact with a target. This is largely because, as shown in FIG. 1C, fragmentation occurs from a pointed surface that tears the connective material 226 between the joint 219 and inner surface 234 of central cavity 204. Hence, less stress is needed upon impact to effectuate fragmentation. In some embodiments, slots 208 are formed by a blade having an angular edge that forms the pointed connective material 226. In other words, projectile 200 requires a reduced separation force and thus less kinetic energy must be expended to fragment the petals 210, which in turn causes a more significant impact on the target.

Figure 3A:
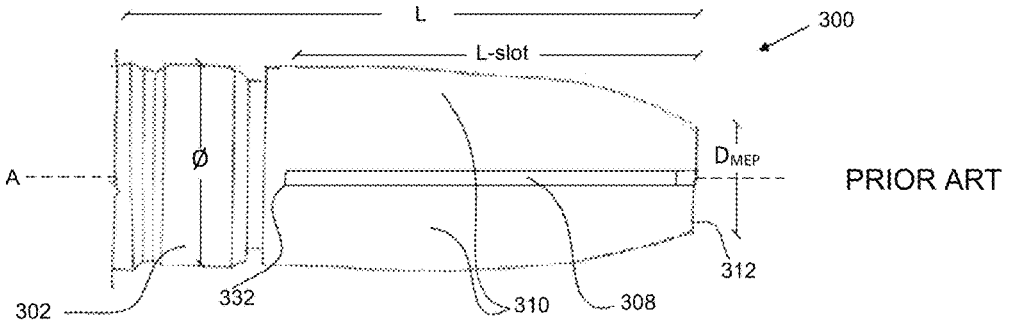
FIG. 3A is a first side view of prior art projectile.
Figure 3B:
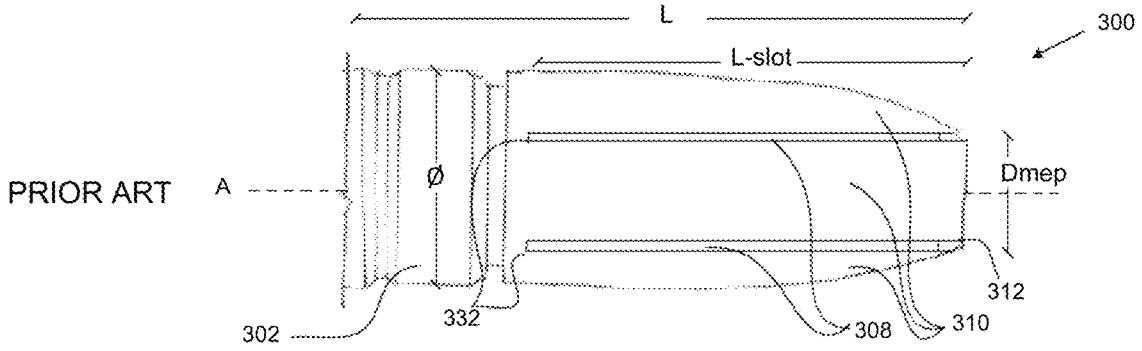
FIG. 3B is a second side view of the prior art projectile of FIG. 3A.
Figure 3C:
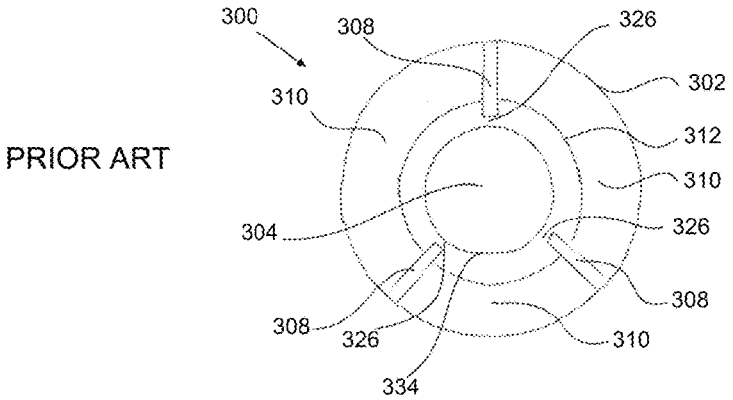
FIG. 3C is a meplat end view of the prior art projectile of FIG. 3A.
Figure 5A:
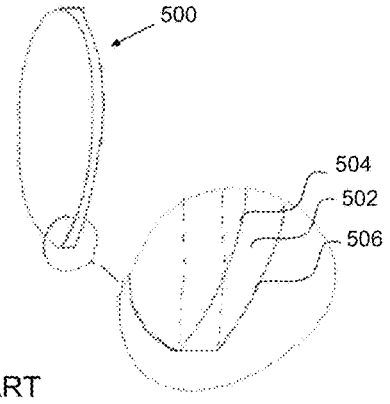
PRIOR ART FIG. 5A
FIG. 5A is a detailed view of a prior art cutting tool edge.
Figure 5B:
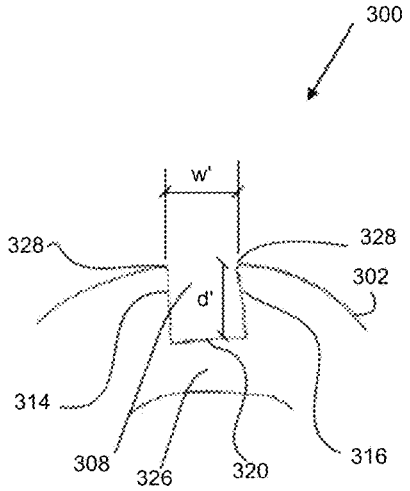
FIG. 5B PRIOR ART
FIG. 5B is partial sectional view of a cut formed by the prior art cutting tool of FIG. 5A.

In contrast, when a projectile having slots 308 with parallel congruent surfaces 314, 316, as shown in FIGS. 3C and 5B, impacts a target, more stress is needed to effectuate fragmentation because the bottom portion of each slot 308 tears from the connective material 326 along a blunt surface. Slots 308 are typically formed by a cutting tool having a flat edge, which produces the wide, flat connective material 326. Accordingly, projectile 300 having a wide, flat connective material 326 formed by a traditional cutting blade requires much more separation force in order to fragment adjoining petals 310 upon impact with a target.

Additionally, a projectile having slots 208 with divergent surfaces 214, 216 exhibits significantly improved fracturing between adjacent petals 210 as compared to a projectile having slots 308 with parallel walls 314, 316, regardless of width, depth, and/or length of slots 208 and/or whether joints 219 of slots 208 have a curved proximal portion or a linear proximal portion. Projectiles having a curved proximal portion are discussed in more detail below.

Congruent surfaces 214, 216 intersect along a joint 219 that extends from a rear slot termination point 232 to or toward the meplat 212. As shown in FIG. 1D, each congruent surface 214, 216 intersects cylindrical outer surface 222 and curved outer surface 224 of projectile 200 at an outer intersection curve 228. In some embodiments, as shown in FIG. 1B, outer intersection curve 228 on either side of petal 210 forms a smoothly tapered shape of petal 210, wherein the maximum width of petal 210 is at its distal end and the minimum width of petal 210 is at its proximal end. In some embodiments, congruent surfaces 214, 216 may extend from a front edge 230 to a rear slot termination point 232. The intersection of front edges 230, 230 and joint 219 defines a portion of the pointed connective material 226 discussed above.

Figure 11A:
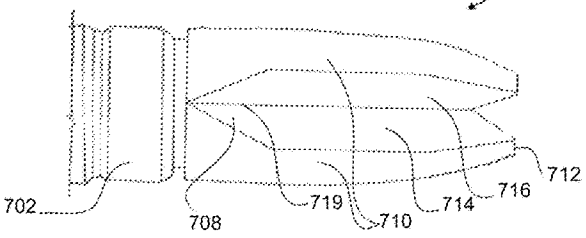
FIG. 11A is a side view of another embodiment of a hybridized fragmenting projectile having two petals alternatingly arranged with two slots.
Figure 12B:
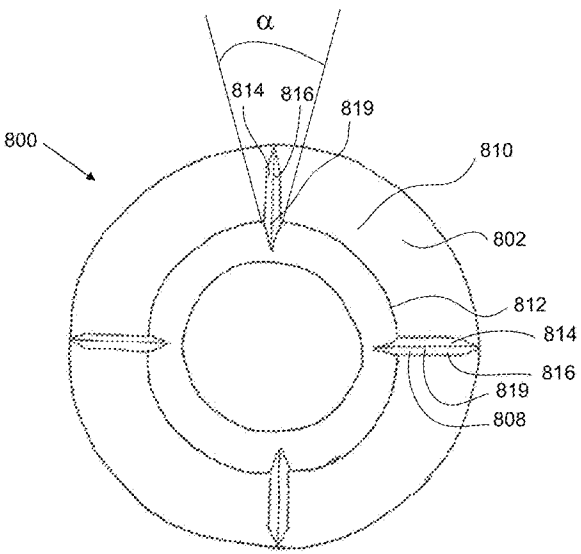
FIG. 12B is a meplat end view of the projectile shown in FIG. 12A.
Figure 11B:
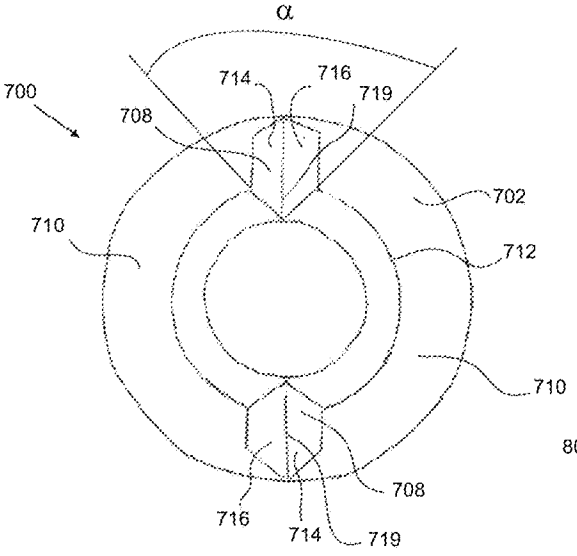
FIG. 11B is a meplat end view of the projectile shown in FIG. 11A.
Figure 10E:
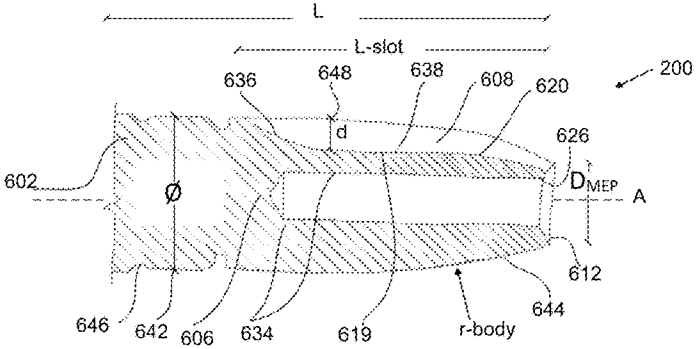

As shown in FIG. 1C, each slot 208 has a slot angle (a) that can vary as desired for a particular application, projectile caliber, or other parameter. The number of petals 210 may limit the size of the slot angle. For example, the slot angle for a 2-slot projectile 700 (see FIG. 11B) would be greater than the slot angle of a 3-slot projectile 200 (see FIG. 1C), which in turn would be greater than the slot angle of a 4-slot projectile 800 (see FIG. 12B), and so on. In some embodiments, a substantially equal total volume of material may be removed from the starting raw material to form the slots in each instance, thus maintaining similar bullet grain weights for all three aforementioned example projectiles. Likewise, the slot angle may vary for different calibers Ø, overall slot length ("L-slot"), or desired volume of connective material 226. The meplat end views of FIGS. 1C, 11B, and 12B are presented to illustrate that the total volume of the slots may be similar in various embodiments.

Figure 2A:
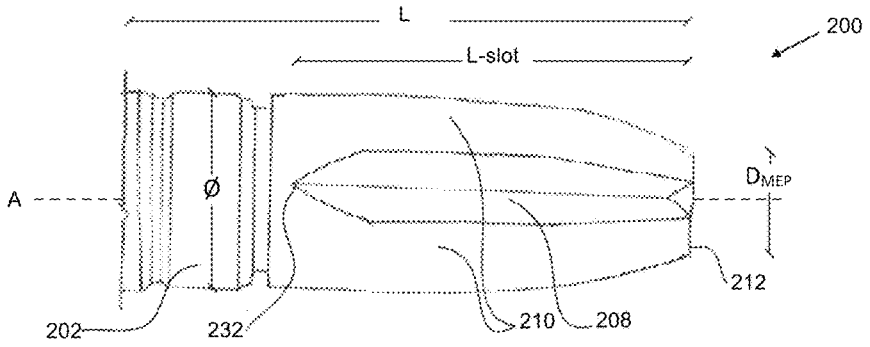
FIG. 2A is a first side view of the projectile of FIG. 1A.
Figure 2B:
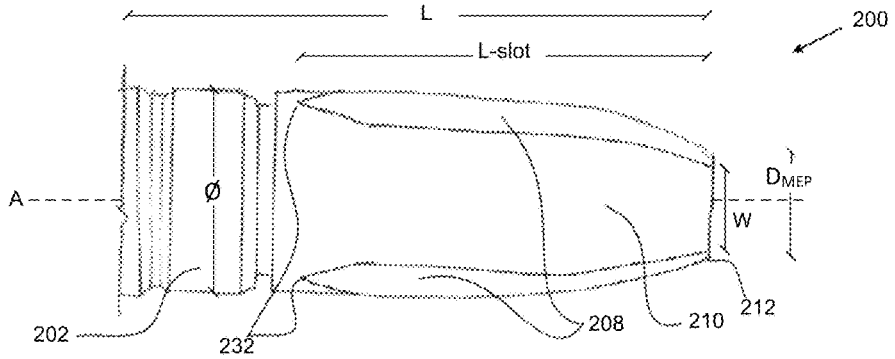
FIG. 2B is a second side view of the projectile of FIG. 1A.

FIGS. 2A and 2B are first and second side views, respectively, of projectile 200 of FIG. 1A. Projectile body 202 has a body length "L" and a caliber Ø (e.g., the maximum body diameter). In some embodiments, the body length (L) is about 1 inch to about 3 inches, such as about 1.1 inches to about 2 inches, or about 1.2 inches to about 1.5 inches. In some embodiments, the caliber Ø is about 0.2 inch to about 0.4 inch, such as about 0.25 inch to about 0.357 inch, or about 0.308 inch to about 0.355 inch. Each slot 208 has a slot length ("L-slot"), as measured along the longitudinal axis A of projectile body 202, from meplat 212 to rear slot termination point 232. In some embodiments, the slot length (L-slot) is about 0.5 inch to about 1.5 inches, such as about 0.62 inch to about 1 inch.

Meplat 212 has a front end meplat diameter $D_{MEP}$. As shown in FIGS. 2A and 2B, projectile body 202 includes three slots 208, alternatingly separated by three petals 210. Slots 208 may be spaced equidistant, for example, or may be spaced at various radial locations thus forming either equal sized petals 210 or petals 210 of varying size. Petals 210 have a front end meplat width W (see FIG. 2B), which is measured linearly across a width of the petal 210 at the meplat 212. The meplat width W may increase as the distance from the meplat 212 increases, whereby the minimum meplat width W is located at the meplat 212. Alternatively, the minimum meplat width W may be located along the length of the petal 210 due to manufacturing depth movements of the slotting tool 400 as described in more detail below.

In contrast, FIGS. 3A-3C depict a prior art projectile 300 with a projectile body 302 having a length L and caliber Ø that matches the length and caliber of the depicted example projectile 200. Projectile body 302 includes three longitudinal slots 308 that are spaced from each other by, and define, three petals 310. Each slot 308 has a slot length (L-slot) measured along the longitudinal axis A of projectile body 302 from meplat 312 to rear slot termination point 332, which matches the L-slot of the depicted example projectile 200. Meplat 312 has a $D_{MEP}$ at the front end of meplat 312. Projectile 300 has a central cavity 304 surrounded by petals 310.

Projectile 200 has the mechanical ability to fragment effectively at subsonic and supersonic speeds—i.e., above and below the speed of sound. Effective fragmentation includes mechanical fracturing (purposeful material fracturing/failure) of petals from each other and may also include mechanical fracturing of petals from the base. In some embodiments, the base remains intact (i.e., not split or fractured in unintended areas). The size of fragmented/expanded petals is a function of the speed of the projectile upon impact with a target. Therefore, the size of fractured petals (after petals 210 have separated from the base) can vary among successful projectiles 200. At faster speeds, the petals 210 may fracture into multiple, smaller weight, fractured pieces upon impact with a target. At slower speeds, the number of fractured pieces may be closer to or the same as the number of petals 210.

Figure 4A:
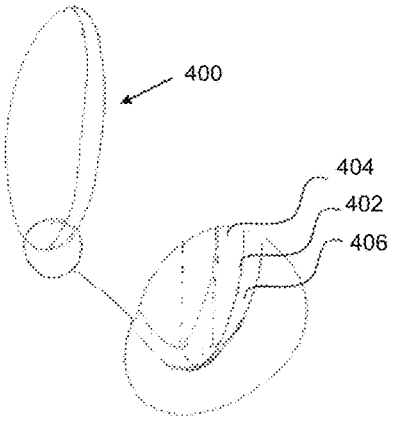
FIG. 4A is a detailed view of a slotting tool edge.
Figure 4B:
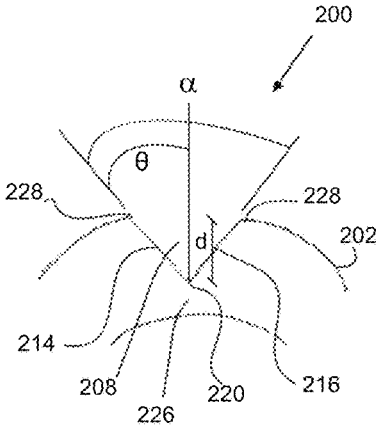
FIG. 4B is partial sectional view of a slot formed by the slotting tool of FIG. 4A.

FIG. 4A is a detailed view of an example slotting tool edge 402 of a slotting tool 400. The slotting tool 400 is similar to a threading tool that may be used to score metal cylinders to form threads and is not specifically designed for manufacturing projectiles. Various slotting tools may be used in manufacturing the disclosed projectile, such as V-groove router bits, reciprocating metal-cutting tapered files, or the like. Slotting tool 400 has a pointed, V-shaped edge 402, which may have equal sides 404, 406 angled in a range of about 10 to about 110°. Each side 404, 406 may vary in size and angle. FIG. 4B is a partial sectional view of a slot 208 formed by slotting tool 400 of FIG. 4A. When used to score projectile body 202, edge 402 may form a matching slot 208 having a slot angle $\alpha$ in the range of about 100 to about 110°. For example, slotting tool 400 having a 60° angled edge 402 would form divergent congruent surfaces 214, 216 having an offset angle $\theta$ of 30° measured radially from a tangential direction along the outer surface of projectile body 202 (i.e., half of a slot angle of 60°). Likewise, slotting tool 400 may be tilted in relation to the outer surface of projectile body 202 to form a slot 208 having unequal offset angles $\theta$. The depth (d) of slot 208 is directly related to the amount of force needed to shear the connective material 226.

In contrast, FIG. 5A is a detailed view of a cutting tool edge 502 (e.g., a blade edge) of a cutting tool 500, which is comparable to a circular saw blade commonly used for forming cuts or troughs. Cutting tool 500 has a flat, rectangular-shaped blade edge 502, which has right angled corners 504, 506. FIG. 5B is a partial sectional view of a slot 308 formed by cutting tool 500. When used to cut projectile body 302, edge 502 forms a matching slot 308 having a rectangular cross sectional opening having a width (w') and a depth (d'). Slot 308 has a relatively wide, flat bottom surface 320 and two parallel walls 314, 316. For other projectiles of the same caliber and having a slot 308 of a depth (d') similar to a depth (d) of slot 208, the amount of force (stress) required to shear the connective material 326 of slot 308 is substantially larger than the amount of force required to shear the connective material 226 of slot 208.

Figure 6:
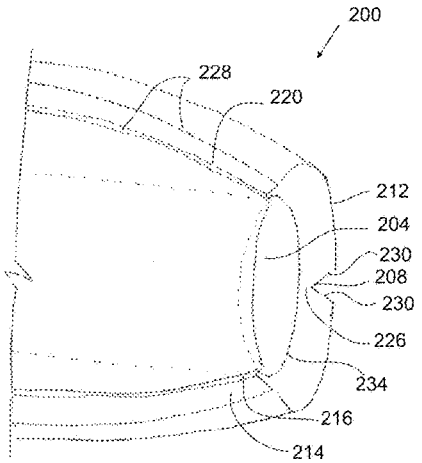
FIG. 6 is a partial meplat perspective view of the projectile of FIG. 1A.
Figure 8:
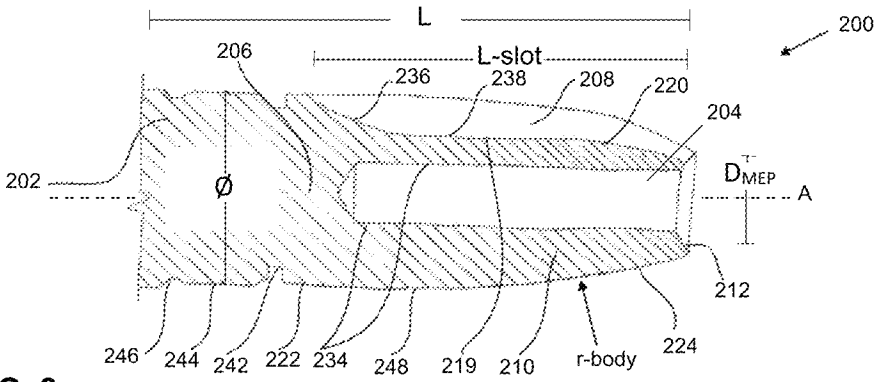
FIG. 8 is a side sectional view of the projectile of FIG. 1A.

When projectile 200 impacts a target, the projectile fractures by shearing the petals 210 from each other along a portion or all of joints 219. In some embodiments, a front most portion 220 of the joint 219 that is proximal the meplat 212 is curved. This portion 220 is referred to herein as the "curved proximal portion." See FIGS. 6 and 8 showing curved proximal portion 220. In some embodiments, the curved proximal portion 220 comprises the front most one-third portion of the joint 219. The curved proximal portion 220 may have an angular radius that either varies or is substantially constant along its length.

FIG. 6 is an enlarged partial perspective view of meplat 212 of a three-slot projectile 200. A portion of each petal 210 forms the curved proximal portion 220, shown as a curved tip portion. The depicted projectile 200 has three slots 208, three petals 210, and three curved proximal portions 220. Central cavity 204 has an inner surface 234, and may have a constant diameter and cylindrical-shape as may be achieved by deep drilling into the central core of a raw material (e.g., a projectile blank). In some embodiments, the central cavity 204 may have a non-constant diameter—e.g., a diameter that increases or decreases along its length.

Figure 7B:
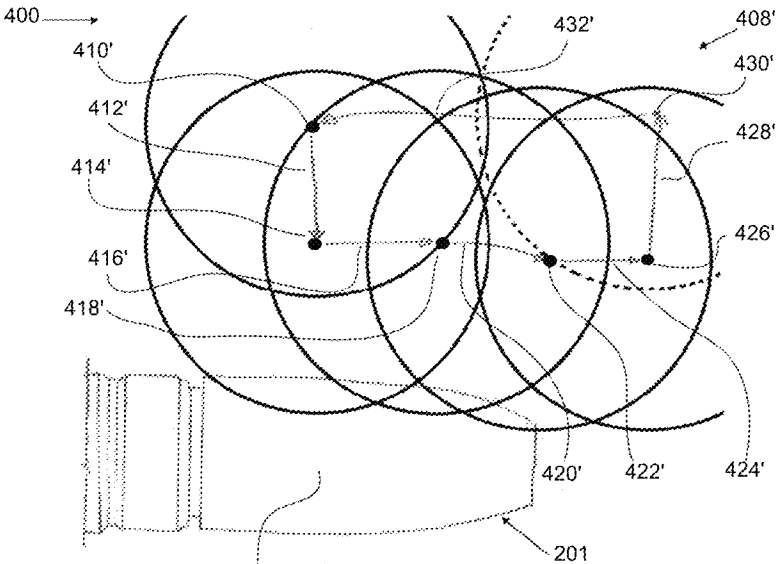
FIG. 7B is an alternate slotting tool movement diagram illustrating another slotting path used to form the slot of FIG. 1D.
Figure 7A:
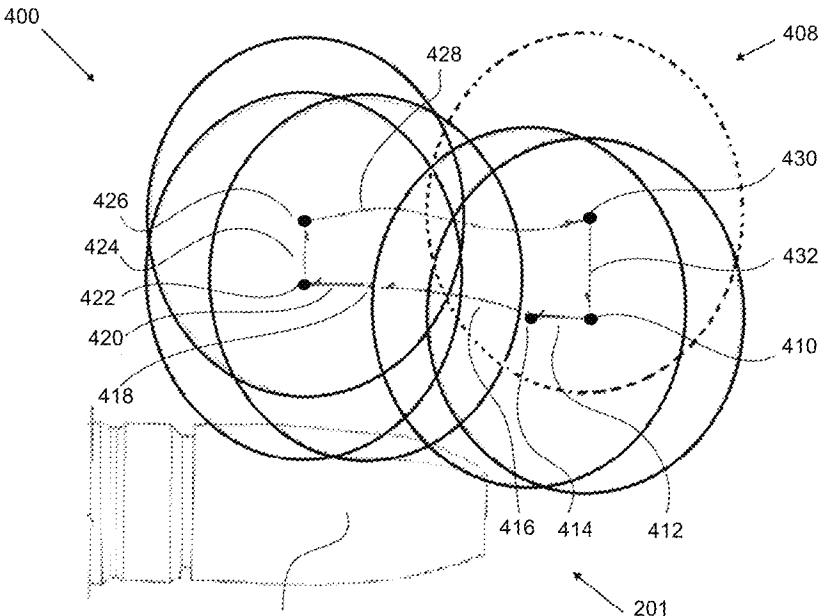
FIG. 7A is a slotting tool movement diagram illustrating the slotting path used to form the slot of FIG. 1D.

FIG. 7A is a diagram depicting one example of a method of manufacturing the slots 208 of projectile 200. In this figure, the movement of slotting tool 400 is shown along a slotting path 408 in order to form a slot 208 in a projectile blank 201. In general, a projectile blank 201 is a raw material that may be a generally cylindrical piece of metal of the approximate size of the projectile to be produced. Multiple points along slotting path 408 illustrate the center of rotating slotting tool 400, and designate locations where the path may change course. In one embodiment, slotting tool 400 starts at point 410 and then begins to rotate (e.g., at a normal operating speed), making an entry cut 412 into projectile body 203 from point 410 to point 414. Slotting tool 400 is gradually raised while simultaneously translating along an expanding cut 416 from point 414 to point 418. Expanding cut 416 may follow a linear or non-linear (e.g., curvilinear) path, as shown in FIG. 7A. In the depicted embodiment, slotting tool 400 continues along a linear cut 420 from point 418 to point 422, at which point slotting tool 400 has completed slot 208. Slotting tool 400 may move along a linear removing cut path 424 in order to completely remove slotting tool 400 from projectile blank 201 from point 422 to point 426. Slotting tool 400 is then moved along a path 428 from point 426 to point 430, and along a returning path 432 to the initial starting point 410. Paths 428 and 432 may be combined into one single non-linear returning path to return the slotting tool 400 to the initial starting point 410. The projectile blank 201 may then be rotated to the location of the next slot 208 and the slotting process is repeated. Alternatively, for example, two or more slotting tools 400 may be simultaneously moved along the slotting path 408 to form two or more slots 208 on a projectile blank 201 at the same time. Likewise, the slotting tool 400 may be stationary and the projectile 200 may be moved along the slotting path 408 to form the slot 208. To form the slots 208 of projectile 200, the foregoing steps may be performed in a different order, some or all of the steps may be eliminated, and/or additional steps may be added. Likewise, to form slots having alternative shapes on a projectile blank, other slotting paths may be followed.

FIG. 7B is a diagram depicting another example of a method of manufacturing the slots of projectile 200. In this figure, an alternative movement of slotting tool 400 is shown along a slotting path 408', which may be used to form a slot 208 in a projectile blank 201. In general, slotting path 408' is similar to slotting path 408, but in reverse order. Multiple points along slotting path 408' illustrate the center of rotating slotting tool 400, and designate locations where the path may change course. In one embodiment, slotting tool 400 starts at point 410' and then begins to rotate, making a plunging cut 412' into the projectile body 203 from point 410' to point 414'. Slotting tool 400 continues along a linear cut 416' from point 414' to point 418', and is then gradually lowered while simultaneously translating along a reducing cut 420' from point 418' to point 422'. Reducing cut 420' may follow a linear or non-linear (e.g., curvilinear) path, as shown in FIG. 7B. At point 422' in the depicted embodiment, slot 208 may be complete. In other embodiments, further cutting may be performed. Slotting tool 400 moves along a linear removing cut path 424' to completely remove slotting tool 400 from projectile 200 from point 422' to point 426', thus completing the slot 208. Slotting tool 400 is then raised along a path 428' from point 426' to point 430', and along a returning path 432' to the initial starting point 410'. In some embodiments, paths 428' and 432' may be combined into one single non-linear path to return slotting tool 400 to initial starting point 410'. Projectile blank 201 may then be rotated to the location of the next slot 208, and the slotting process is repeated. In some embodiments, two or more slotting tools 400 may be simultaneously moved along slotting path 408' to form two or more slots 208 on projectile blank 201 at the same time. In some embodiments, the position of slotting tool 400 may be fixed while the projectile blank 201 is moved along slotting path 408' to form slot 208. As noted above, the foregoing steps may be performed in a different order, some or all of the steps may be eliminated, and/or additional steps may be added in order to form the slots 208 of projectile 200.

FIG. 8 is a side sectional view of joint 219 of projectile 200 of FIG. 1A. In general, joint 219 may include one or more of a curved distal segment of constant radius, a linear segment, and a curvilinear proximal segment of non-constant radius. As shown in FIG. 8, joint 219 includes a curved distal portion 236, a linear middle portion 238, and a curved proximal portion 220. Curved distal portion 236 of joint 219 has a constant radius. In some embodiments, the radius of curved distal portion 236 is generally equal to the radius of the slotting tool with which slot 208 is formed. Curved distal portion 236 may be produced during removing cut 424 or plunging cut 412' as described above. Linear middle portion 238 of joint 219 is generally straight. In some embodiments, linear middle portion 238 is substantially parallel to longitudinal axis A. Linear middle portion 238 may be produced during linear cut 420 or 416' as described above. Curved proximal portion 220 may be formed during expanding cut 416 or reducing cut 420' described above.

As further shown in FIG. 8, projectile body 202 may have a cylindrical portion 222 and a forward curved ogive portion 224. A transition point 248 is located approximately midway between cylindrical portion 222 and ogive portion 224. Ogive portion 224, extending from meplat 212 to transition point 248, is defined by an outer surface body radius ("r-body"). In some embodiments, slot 208 is formed completely in front of transition point 248. In other embodiments, a portion of slot 208 extends rearward of transition point 248.

In some embodiments, projectile body 202 may include a fracturing groove 242, a bearing surface 244, cannelures 246, and/or a slightly tapered rear edge 218 (e.g., boat tail). Fracturing groove 242 is a grooved section of projectile 200 that aids in separating petals 210 from base 206. Bearing surface 244 may be any surface that has the same diameter as the bore of a corresponding firearm barrel, which is generally the largest diameter of projectile 200. Bearing surface 244 is seated within open second end 106 of casing 102 by an interference fit. Cannelures 246 are recessed rings generally made on bearing surface 244 to allow a propellant material to displace into them, thus reducing pressure when projectile 200 travels through the firearm barrel. Tapered rear edge 218 allows for smoother feeding during manufacturing and loading, and also improved air flow during flight, by reducing air resistance when projectile 200 is fired at supersonic speed.

In some embodiments, petals 210 include material positioned between fracturing groove 242 and meplat 212. In some embodiments, base 206 includes a solid material positioned between fracturing groove 242 and rear edge 218. Base 206 may be cylindrically shaped after one or more petals 210 have fragmented from the projectile.

Figure 9A:
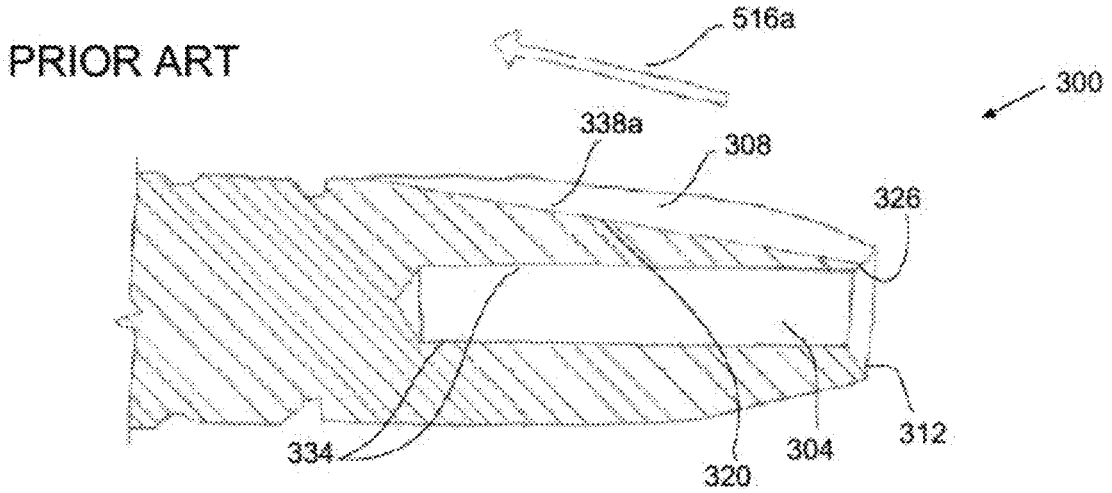
FIG. 9A is a side sectional view of a prior art projectile having an angled linear cut path.
Figure 9B:
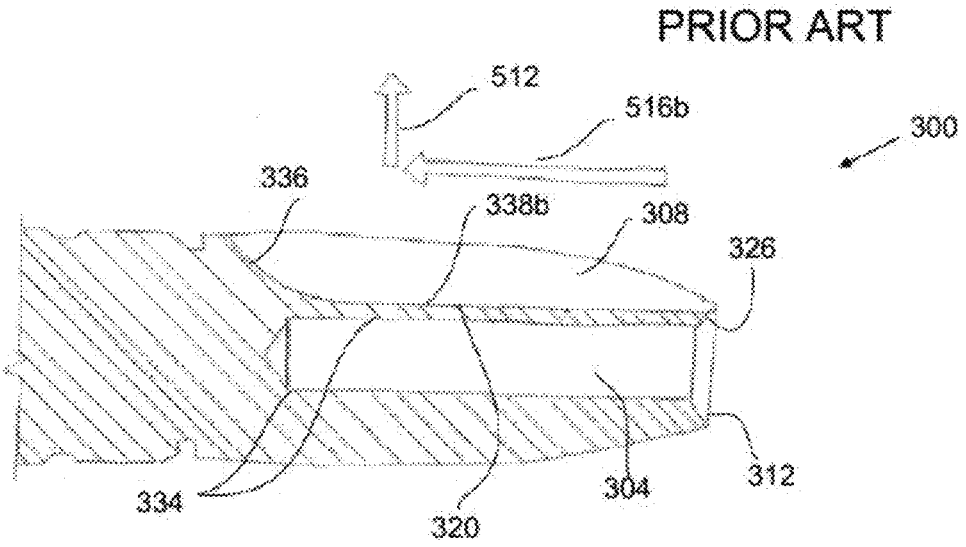
FIG. 9B is a side sectional view of a prior art projectile having a longitudinally-linear cut path.
Figure 10A:
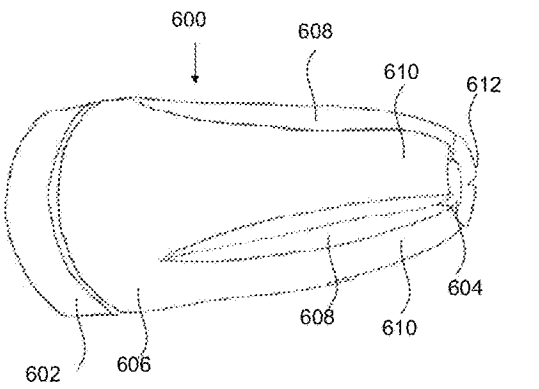
FIGS. 10A-10E depict various views of another embodiment of a hybridized fragmenting projectile having three petals alternatingly arranged with three slots.
Figure 10B:
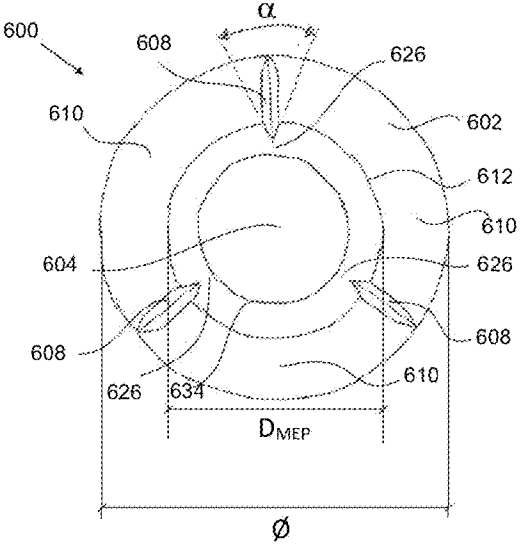
Figure 10C:
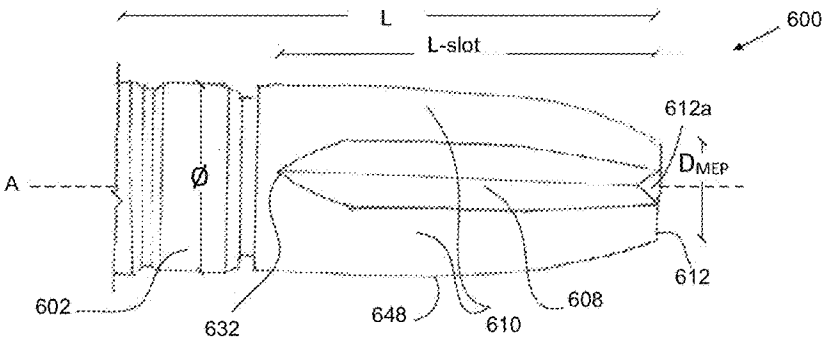
Figure 10D:
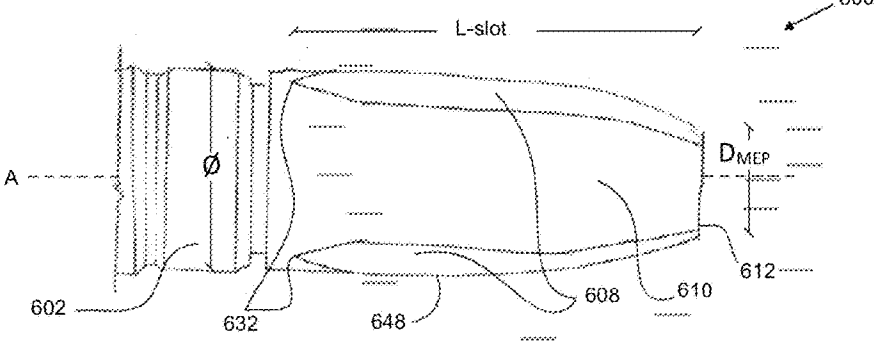

FIGS. 9A and 9B are side sectional views along a bottom surface 320 of projectile 300. As shown in FIG. 9A, the bottom surface 320 of the slot 308 has a linear portion 338*a* that is formed by the cutting tool 500 following a linear cut path 516*a*. As shown in FIG. 9B, bottom surface 320 of slot 308 has a curved distal portion 336 and a linear proximal portion 338*b*. Curved distal portion 336 of bottom surface 320 has a constant radius equal to the radius of cutting tool 500, and is formed by cutting tool 500 following a removal cut path 512 or a plunging cut path. Linear proximal portion 338*b* of bottom surface 320 is formed by cutting tool 500 following a linear cut path 516*b*.

Some embodiments of the disclosed projectile exhibit an advantageous property regardless of whether the slots have divergent or parallel surfaces. In such embodiments, the disclosed projectile includes joints having curved proximal portions 220, which help to provide significantly improved fracturing as compared to a projectile that includes joints having linear (e.g., straight) proximal portions.

The various dimensions of the components described above may be modified as required or desired for a particular application. Certain ratios have been discovered to be particularly beneficial to ensure significant cavity formation during contact with a target as well as to ensure proper feeding from a magazine of an automatic weapon. For example, L-slot as measured along longitudinal axis A from meplat 212 to rear slot termination point 232 may be about 45-60%, such as about 50-55% or about 52%, of the total projectile length L. In some examples, the $D_{MEP}$ may be about 45-60%, such as about 50-55% or about 52%, of the projectile caliber Ø (maximum body diameter). In some embodiments, the selected $D_{MEP}$ allows the cartridge to be fed into an automatic weapon without interference. Other geometric relationships are contemplated and described below. The dimensions of the various portions of the disclosed projectiles assist in enabling those projectiles to function effectively upon impact with a target.

The disclosed projectile, when utilized in a cartridge having an appropriate casing and primer, can be fed from a magazine of virtually any capacity, in either an automatic or semi-automatic weapon.

FIGS. 10A-10E are discussed in Example 1 below. FIG. 11A is a side view of an example fragmenting projectile 700. FIG. 11B is a meplat end view of projectile 700. Several components depicted and described above in previous figures correspond to those in FIGS. 11A-B (e.g., projectile 200 in above-discussed figures corresponds to projectile 700 in FIGS. 11A-B, etc.), and as such need not be described again. Referring to FIGS. 11A-B, projectile 700 includes a body 702 with two petals 710 that form a meplat 712. Petals 710 are spaced from each other by, and define, two longitudinal slots 708. The slots 708 are each defined by two congruent surfaces 714, 716 that also form surfaces of petals 710. Congruent surfaces 714, 716 intersect at joint 719 that is radially equidistant from adjacent petals 710. In this example, each slot 708 has a slot angle α of about 90°. Other slot angles are also contemplated—e.g., about 70°-110° or about 80°-100°.

Figure 12A:
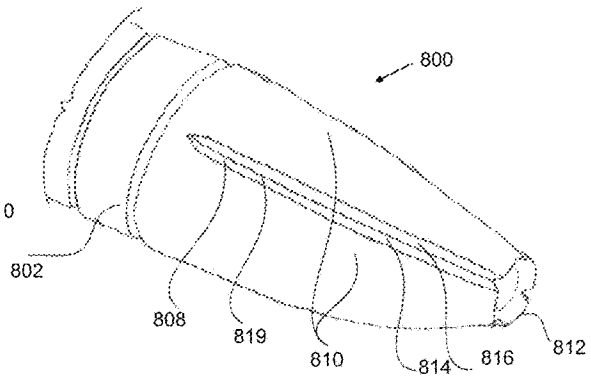
FIG. 12A is a perspective view of another embodiment of a hybridized fragmenting projectile having four petals alternatingly arranged with four slots.

FIG. 12A is a perspective view of an example fragmenting projectile 800. FIG. 12B is a meplat end view of the projectile 800. Several components depicted and described above in previous figures correspond to those in FIGS. 12A-B (e.g., projectile 200 in above-discussed figures corresponds to projectile 800 in FIGS. 12A-B, etc.), and as such need not be described again. Referring to FIGS. 12A-B, projectile 800 includes a body 802 with four petals 810 that form a meplat 812. Petals 810 are spaced from each other by, and define, four longitudinal slots 808. The slots 808 are each defined by two congruent surfaces 814, 816 that also form surfaces of petals 810. Congruent surfaces 814, 816 intersect at a joint 819 that is radially equidistant from adjacent petals 810. In this example, each slot 808 has a slot angle α of about 45°. Other slot angles are also contemplated—e.g., about 25°-65° or about 35°-55°.

In some embodiments, projectile 200 may be cast from molten material, or formed from powdered metal alloys. Projections in the mold may form the depicted slots 208, or the slots 208 may be cut into the projectile after casting. Projectile 200, casing 102, primer, and propellant may be assembled manually and/or using automated equipment.

As used herein, the singular forms "a," "an," and "the" include plural references unless the context clearly dictates otherwise. As used herein, terms such as "first" and "second" are used to modify a noun; such use is intended to distinguish one item from another, not to require a sequential order unless specifically stated. As used herein, terms such as "top" and "bottom," "upper" and "lower", or "front" and "rear," are not intended to have absolute orientations but are instead intended to describe relative positions of various components with respect to each other. Lengths, sizes, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

EXAMPLES

The present invention is next described by means of the following examples. The use of these and other examples anywhere in the specification is illustrative only, and in no way limits the scope and meaning of the invention or of any exemplified form. Likewise, the invention is not limited to any particular preferred embodiments described herein. Indeed, modifications and variations of the invention may be apparent to those skilled in the art upon reading this specification, and can be made without departing from its spirit and scope. The invention is therefore to be limited only by the terms of the claims, along with the full scope of equivalents to which the claims are entitled. The numerical values set forth in the examples are reported as precisely as possible. Any numerical values, however, inherently contain certain errors necessarily resulting from the standard deviation found in their respective testing measurements.

Example 1

This example describes a projectile 600 having three equally spaced apart slots, as shown in FIGS. 11A-11E. Reference numerals presented in FIGS. 11A-11E correspond to those described above (e.g., projectile 200 in above-discussed figures corresponds to projectile 600 in FIGS. 11A-11E, etc.). Accordingly, corresponding elements discussed above need not be again described in this example. Projectile 600 has the dimensions identified in Table 1 below. Manufacturing tolerances are not reflected in the figures or Table 1. The slot depth (d) is measured at transition point 648.

TABLE 1

| Dimension | Value |
|---|---|
| Body Length (L) | 1.20" |
| Caliber (Ø) | 0.308" |
| Mepl at Diameter ($D_{MEP}$) | 0.15" |
| Slot Length (L-slot) | 0.62" |
| Slot Depth (d) | 0.05" |
| Body Radius, (r-body) | 0.80" |
| Slot Angle (α) | 60° |

Example 2

This example describes the testing of a 165±1 grain projectile having the dimensions set forth in Example 1. A projectile of Example 1 was discharged from a Ruger American Ranch rifle for subsonic or supersonic testing, or from a Thompson/Center (TC Arms) Compass rifle for further supersonic testing. In each test, the projectile was fired into a 10% ordnance gelatin test block. The results of these tests are provided below.

Ordnance Gel Specification:

The projectile was discharged into a 10% ballistic ordnance gelatin test block manufactured and calibrated in accordance with the FBI Ammunition Testing Protocol, developed by the FBI Academy Firearms Training Unit. The base powder material utilized for the 10% ordnance gelatin test block was VYSE™ Professional Grade Ballistic & Ordnance Gelatin Powder available from Gelatin Innovations, of Schiller Park, Ill. The block was manufactured at the test site in accordance with the formulations and instructions provided by the powder manufacturer. After manufacture of the gelatin test block, the test block was calibrated by discharging a 0.177 steel BB at 584±15 fps into the block. A test block is considered calibrated if the shot penetrates 8.5±1 cm (2.95-3.74 inches). The calibrated block was then used in the terminal performance testing of the projectiles.

Terminal Performance Test 1:

The projectile in a 300 AAC Blackout cartridge was discharged from a Ruger American Ranch rifle at 700 fps into calibrated ballistics gelatin from a distance of 15 feet. The projectile exhibited excellent performance and fragmented effectively as designed. Three separate petals sheared as intended from the solid base. The petals moved in a radial path outward and the base continued along the same straight line of its initial trajectory into the gelatin. The base penetrated approximately 16" into the ballistics gelatin and was recovered. Petals were also recovered. The base weighed approximately 101 grains, and each petal weighed approximately 21.5 grains±0.5 grains.

Terminal Performance Test 2:

The projectile in a 300 AAC Blackout cartridge was discharged from a Ruger American Ranch rifle at 1800 fps into calibrated ballistics gelatin from a distance of 15 feet. The projectile exhibited excellent performance and fragmented effectively as designed. Three separate petals sheared as intended from the solid base. The petals were slightly bent inward as a result of the shape of the ogive. The petals moved in a radial path outward and the base continued along the same straight line of its initial trajectory into the gelatin. The petals being slightly bent did not appear to greatly influence their path through the gelatin. The base exited the gelatin test block and was recovered, weighing approximately 100 grains. The petals also exited the gelatin test block and were recovered, and each petal weighed approximately 21.5 grains±0.5 grains.

Terminal Performance Test 3: The projectile in a 300 Winchester Magnum was discharged from a TC Compass rifle at 3300 fps into calibrated ballistics gelatin from a distance of 15 feet. The projectile exhibited excellent performance and fragmented effectively as designed. Due to the overwhelming energy displaced within the gelatin test block, no large petals were found inside the gelatin block. Only small petals (weighing 1.0 grains or less) were found inside the gelatin test block and had moved in a radial path outward. The base continued along the same straight line of its initial trajectory into the gelatin test block. The base exited the gelatin test block and was recovered, weighing about 103 grains. Not all petals were recovered due to the energy associated, but recovered pieces weighed approximately >1.0 grains to 11.5 grains.

What is claimed is:

1. A hybridized fragmenting projectile, comprising:

a base having a central cavity;

at least two adjacent petals integrally formed with the base, surrounding the central cavity, and separated from each other by a slot having divergent surfaces, wherein the divergent surfaces intersect at a joint; and a meplat;

wherein the projectile is configured to fragment upon impact with a target after being fired from a firearm, regardless of whether the projectile is fired at supersonic or subsonic speed.

2. The hybridized fragmenting projectile of claim 1, wherein at least one petal is configured to separate from the base and form fragments upon impact with the target.

3. The hybridized fragmenting projectile of claim 1, wherein the projectile is configured to fragment upon impact at a speed of less than 1100 fps.

4. The hybridized fragmenting projectile of claim 3, wherein the projectile is further configured to fragment upon impact at a speed of more than 1100 fps.

5. The hybridized fragmenting projectile of claim 1, comprising three petals alternatingly arranged with three slots.

6. The hybridized fragmenting projectile of claim 1, comprising four petals alternatingly arranged with four slots.

7. The hybridized fragmenting projectile of claim 1, wherein the joint comprises a curved proximal portion.

8. The hybridized fragmenting projectile of claim 7, wherein the joint further comprises a curved distal portion.

9. The hybridized fragmenting projectile of claim 7, wherein the joint further comprises a linear middle portion.

10. The hybridized fragmenting projectile of claim 9, wherein the linear middle portion is substantially parallel to a longitudinal axis of the projectile.

11. A method of manufacturing a slot of a hybridized fragmenting projectile, comprising the steps of:

(a) making an entry cut into an outer surface of a projectile blank;

(b) translating the cut longitudinally along a first curved path in the outer surface of the projectile blank;

(c) translating the cut longitudinally along a linear path in the outer surface of the projectile blank, wherein the linear path is substantially parallel to a longitudinal axis of the projectile body;

(d) translating the cut longitudinally along a second curved path in the outer surface of the projectile blank; and (e) terminating the cut to form the slot.

12. The method of claim 11, wherein step (b) is performed before step (c).

13. The method of claim 11, wherein step (b) is performed after step (c).

14. The method of claim 11, wherein the cuts are formed using a rotating circular tool.

15. The method of claim 14, wherein the rotating circular tool comprises a blade having an edge with angled sides.

16. A cartridge containing the hybridized fragmenting projectile of claim 1.

* * * * *